US012123303B2

(12) United States Patent
Syresin et al.

(10) Patent No.: US 12,123,303 B2
(45) **Date of Patent: *Oct. 22, 2024**

(54) METHOD AND SYSTEM FOR DETERMINING THE FLOW RATES OF MULTIPHASE AND/OR MULTI-COMPONENT FLUID PRODUCED FROM AN OIL AND GAS WELL

(71) Applicant: Schlumberger Technology Corporation, Sugar Land, TX (US)

(72) Inventors: Denis Syresin, Nur-Sultan (KZ); Ivan Vrabie, Houston, TX (US); Pavel Evgenievich Spesivtsev, Sugar Land, TX (US); Jean-Philippe Hussenet, Sugar Land, TX (US); Bertrand Theuveny, Paris (FR); Victor Korneev, Moscow (RU); Nikolay Tarelko, Moscow (RU)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/471,320

(22) Filed: Sep. 21, 2023

(65) Prior Publication Data

US 2024/0011395 A1 Jan. 11, 2024

Related U.S. Application Data

(63) Continuation of application No. 17/243,630, filed on Apr. 29, 2021, now Pat. No. 11,808,149.

(30) Foreign Application Priority Data

Apr. 30, 2020 (RU) ..... RU2020120833

(51) Int. Cl.
*E21B 47/10* (2012.01)
*E21B 49/08* (2006.01)

(52) U.S. Cl.
CPC ..... *E21B 49/0875* (2020.05); *E21B 47/10* (2013.01); *E21B 2200/20* (2020.05); *E21B 2200/22* (2020.05)

(58) Field of Classification Search
CPC .. E21B 49/0875; E21B 47/10; E21B 2200/20; E21B 2200/22
See application file for complete search history.

(56) References Cited

U.S. PATENT DOCUMENTS 9,605,529 B1 * 3/2017 Venter ..... G06F 30/20
10,422,220 B2 * 9/2019 Enkababian ..... E21B 34/14
(Continued)

FOREIGN PATENT DOCUMENTS

RU 2532489 C1 * 11/2014

OTHER PUBLICATIONS

RU2532489C1 (Year: 2014).*

*Primary Examiner* — Manish S Shah
*Assistant Examiner* — Sharad Timilsina
(74) *Attorney, Agent, or Firm* — Jeffrey D. Frantz

(57) ABSTRACT

A method and system for determining a flow rate of at least a phase or a component of a fluid produced from an oil and gas well are presented hereinafter. The fluid is one of a multiphase and of a multicomponent fluid. The method comprises, in a training phase, collecting primary measurements of pressure, temperature, and additional flow parameter of the produced fluid. The primary measurements are carried out at the wellhead by a set of sensors installed in a flow line for the produced fluid. In the training phase, the method also comprises collecting a flow rate of at least one of the phases or components of the produced fluid simulta-
(Continued)

neously measured by a reference multiphase flow meter installed in the flow line. It also includes establishing a relationship between the pressure, temperature, and the additional flow parameter and the flow rate of the at least one of the phases or components of the produced fluid. The method also comprises, in a subsequent production phase, determining the flow rate of the at least one of the phases or components of the produced fluid based on the primary measurements of the pressure, temperature, and the at least one additional flow parameter and on the established relationship.

20 Claims, 8 Drawing Sheets

(56) References Cited

U.S. PATENT DOCUMENTS

| | | | | |
|---|---|---|---|---|
| 2017/0044876 | A1* | 2/2017 | Romer | E21B 47/07 |
| 2017/0177761 | A1* | 6/2017 | Early | E21B 41/00 |
| 2018/0010443 | A1* | 1/2018 | Lu | E21B 49/08 |
| 2018/0188101 | A1* | 7/2018 | Weindl | G01F 25/14 |
| 2019/0145803 | A1* | 5/2019 | Zhang | G01F 1/002 702/45 |
| 2019/0203581 | A1* | 7/2019 | Raman | E21B 49/08 |

* cited by examiner

METHOD AND SYSTEM FOR DETERMINING THE FLOW RATES OF MULTIPHASE AND/OR MULTI-COMPONENT FLUID PRODUCED FROM AN OIL AND GAS WELL

This application is a continuation of U.S. patent application Ser. No. 17/243,630, filed on Apr. 29, 2021, which claims the benefit of and priority to Russia Patent Application No. 2020120833, filed on Apr. 30, 2020. Each of the above applications is incorporated herein by reference in its entirety.

TECHNICAL FIELD

The invention relates to the production of multiphase and/or multicomponent fluids from oil and gas wells, and is intended to measure the flow rates of phases and/or components of the produced fluids.

BACKGROUND OF THE INVENTION

During extraction, the oil produced from the well reaches the surface as a multiphase and/or multi-component mixture through a pipeline. At the surface of the wellhead, the parameters of this flow need to be determined in order to control production. Extraction volume data for each component is used to analyze and predict well performance.

A method for controlling well productivity is known from prior art (Russian patent No. 2,338,873), which provides for the use of a plurality of low-precision flow meters, each, located in the outlet pipelines of the monitored wells forming a cluster of wells, and of a high-precision flow meter, the output of which is connected to the main pipeline. This approach makes it possible to switch the high-precision flow meter between wells in the event of a change in flow parameters for a specific well, and monitor the flow rates from each well. Consequently, the cost effectiveness of the system for monitoring the productivity of a group of wells is significantly improved. This approach does not however enable to perform accurate, continuous measurements for each well in real time due to the presence of only one high-precision flow meter. Moreover, using even one high-precision flow meter may be quite costly.

Russian patent No. 2,513,812 describes a system and method for determining flow rates in wells equipped with electric submersible pumps connected with two pressure gauges: one upstream of the pumps and one downstream. The flow rates can be computed in real-time mode with the help of a mathematical model, which uses the pressure difference between the pressure gauges and the amount of power consumed by the pump. The accuracy of the measurement is however not optimal due to the use equipment and sensor systems (e.g., pump pressure gauges) located at considerable distances from one another and also not originally designed for metrology and flow-rate purposes.

SUMMARY OF THE DISCLOSURE

The object of the disclosure includes a system and a method that measure flow rates with high accuracy at the outlet of the well, including being able to conduct metrological studies and store an extensive set of data related to flow rates per component for the well, which is required to effectively control the productivity of the well and reservoir.

The disclosure relates to a method for determining a flow rate of at least a phase or a component of a fluid produced from an oil and gas well. The fluid is one of a multiphase and of a multicomponent fluid. The method comprises, in a training phase, collecting primary measurements of pressure, temperature, and at least one additional parameter of the flow of the produced fluid. The primary measurements are carried out at the wellhead by a set of sensors installed in a flow line for the produced fluid. In the training phase, the method also comprises collecting a flow rate of at least one of the phases or components of the produced fluid simultaneously measured by a reference multiphase flow meter installed in the flow line, and establishing a relationship between the pressure, temperature, and the additional at least one additional flow parameter and the flow rate of the at least one of the phases or components of the produced fluid. The method also comprises, in a subsequent production phase, determining the flow rate of the at least one of the phases or components of the produced fluid based on the primary measurements of the pressure, temperature, and the at least one additional flow parameter and on the established relationship.

The disclosure also relates to a system for determining a flow rate of at least a phase or component of a fluid produced from an oil and gas well. The fluid is one of a multiphase and of a multicomponent fluid. The system comprises a set of sensors configured to carry out primary measurements including a measurement of pressure, temperature, and at least one additional flow parameter of the produced fluid, and installed in the produced fluid flow line at the wellhead. It also comprises a reference multiphase flow meter configured to measure the flow rate of the at least one of the phases or components of the produced fluid and installed in the flow line of the produced fluid at the wellhead. The system also includes a computing module configured to collect the primary measurements from the set of sensors and the flow rate of the at least one of the phases or components from the reference multiphase flowmeter and establish a relationship between the measured pressure, temperature, and additional flow parameter of the produced fluid and the flow rate of the at least one of the phases and/or components of the produced fluid. The computing module is also configured to determine the flow rate of the at least one of the phases or components of the produced fluid based on the primary measurements and the established relationship.

The disclosure also relates to method for determining a flow rate of at least a phase or a component of a fluid produced from an oil and gas well. The fluid is one of a multiphase and of a multicomponent fluid. The method comprises determining a flow rate of at least one of the phases or components of the produced fluid based on primary measurements of pressure, temperature, and at least one additional flow parameter and on an established relationship. The primary measurements are carried out at the wellhead by a set of sensors installed in a flow line for the produced fluid. The relationship has been established based on the primary measurements of pressure, temperature, and at least one additional flow parameter and on a flow rate of at least one of the phases or components of the produced fluid simultaneously measured by a reference multiphase flow meter installed in the flow line.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DISCLOSURE OF THE METHOD

Figure 1:
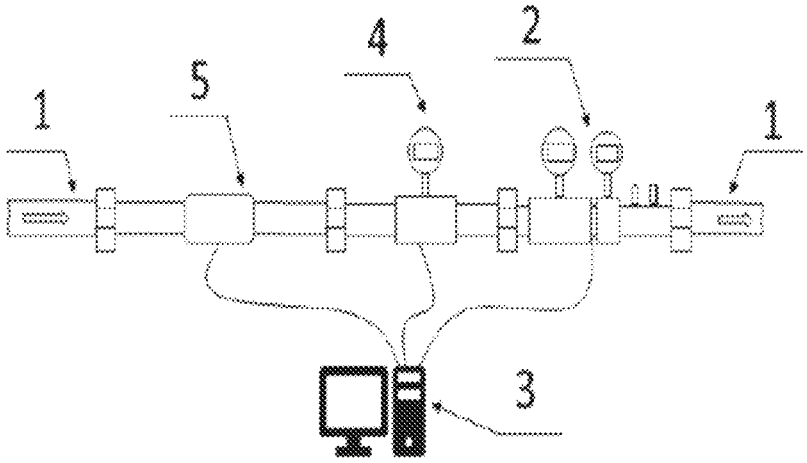
FIG. 1 is a diagram of a system according to an embodiment of the disclosure, for measuring flow rates of multiphase and multicomponent fluids.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity and does not in itself dictate a relationship between the various embodiments and/or configurations discussed.

The disclosure relates to the use a set of sensors sensitive to a certain set of parameters of multi-component and/or multiphase fluid flow produced from the well (total mass flow rate, volumetric flow rates, pressure and temperature of the fluid flow, effective fluid density, effective mixture viscosity, etc.) in order to measure these parameters. A computing module is responsible for data acquisition and processing using mathematical models and algorithms, which allows for converting the data flow generated during measurements into flow rates for each of the phases and components (oil, water, gas). Supervised machine learning techniques, e.g., may optionally be used as mathematical models. The models are trained using a reference multiphase flow meter, which is installed along with the set of sensors during a first phase corresponding to a training phase. The flowmeter provides accurate, continuous measurement results for the flow rates of the phases and/or components of the produced flow, and acts as a "trainer." Using the data from the sensor set and the reference flow meter data, the relationship (correlation) between the flow rates of the phases and/or components and the sensor readings may be retrieved. In other words, establishing the relationship may include training a machine learning model. Such training may include setting one or more coefficients of a machine learning model based on the data collected from the set of sensors and the reference flowmeter.

If necessary, special equipment—a training device—may additionally be used in order to change the flow parameters and properties (such as the water cut (WC), the gas factor (GVF), and the like) in order to cover a wider range of flow parameter values during the training phase. Upon completion of the learning process corresponding to the end of the training phase, the reference flow meter and trainer may be disconnected from the system and the phase and/or component flow rates will be computed using only the data received from the set of sensors and the trained mathematical model. Thus, the reference flow meter being only used for a short training phase, this system makes it possible to measure phase and component flow rates with high accuracy, without having to use an accurate, but often expensive reference flow meter on a continuing basis. The same reference flow meter may be used to train sequentially several wells of one or more clusters and the system, therefore limiting the costs associated to the method without compromising on the accuracy of the computed flow rates once the flow meter has been disconnected.

A diagram of an embodiment of a system for measuring the flow rates of multiphase and multicomponent fluids according to the disclosure is shown on FIG. 1. Multiphase flow refers to fluid flow with at least two different thermodynamic phases, i.e., liquid and gas. Multi-component flow refers to fluid flow with two or more chemical components, e.g., oil, water, or methane. Measurements are performed at the wellhead of a wellbore at the surface. As shown in FIG. 1, a flow line 1 connected to a well (not shown) includes a set of sensors 2 and a computing module 3 connected to each sensor of the set and designed to collect and process measurement results.

A multiphase reference flow meter 4 and, if necessary, an additional training device 5 are installed on the same flow line 1 during a first training phase. As explained earlier, the reference flow meter 4 and training device are not installed permanently on the flow line 1 and, once the training phase is over, may be disconnected from the flow line 1, contrary to the set of sensors 2.

The flow of fluids produced from the well enters flow line 1. During the training phase, the sensors 2 perform continuous primary measurements of pressure, temperature and at least one additional flow parameter for the produced multiphase and/or multicomponent fluid. At the same time, the reference flow meter 4 measures the flow rates of the phases and components of the produced fluid, also in a continuous manner. All the data obtained during the measurement process are fed to computing module 3 for data acquisition and processing.

Additional flow parameters to which the installed sensors may be sensitive as they change may include at least one of the following: effective fluid flow rate, velocity of each of the components and/or phases, sound speed in the flow medium, effective density of a mixture of components or one or more phases, volume and mass flow rate of one or more components or phases, volume fraction of one or more components (such as water) or phases, component viscosities and effective viscosity, dielectric permittivity or conductivity of fluids of the flow.

The set of sensors 2 may be selected depending on the expected properties of the multiphase and/or multicomponent flow at a specific well and the number of components included therein. The expected properties and number of components may have been estimated from previous downhole and/or surface measurement performed before production, such as during well testing. For example, when installing sensors in a well with low or zero water content in the flow, installation of sensors, which are sensitive to dielectric permittivity, may not be required, whereas in wells with high water content in the flow, the presence of such sensors can significantly improve the reliability and accuracy of the measurement.

It is mandatory to install pressure- and temperature-sensitive sensors on line 1. Additional sensors may be installed, if the sensitivity or accuracy of the measurement needs to be improved. Such sensors and devices include (Coriolis, electromagnetic, turbine, vortex, ultrasonic) flow meters; restriction devices (venturi tube, diaphragm); ultrasonic sensors (measuring signal transit time, speed of sound, Doppler shift sensors), optical, infrared and X-ray sensors, watercut sensors, including inductance, conductivity, resistance, microwave, capacitance sensors, etc., differential pressure and temperature sensors, thermal sensors.

The main purpose of the set of sensors 2, which are sensitive to certain flow parameters, is to ensure continuous recording of different flow parameters, which will later be used to calculate the flow rate of each phase and/or component.

The computing module 3 may comprise at least a memory storage for storing computer software and instructions as well as the measurement results collected from the set of sensors, a processor for executing the software and instructions stored on the memory storage. Computing module 3 for collecting and processing measurement results consists more particularly of processors and software/instructions designed for the following purposes: data acquisition and storage, data filtering, data preprocessing, flow calculation, system and model correction, automation, and so forth. The computing module 3 may also include a communication device (wired and/or wireless) for communicating with each sensor of the set, for instance via a local or global network. The computing module 3 may comprise one or more units, located at the wellsite and/or remotely from the wellsite. An exemplary of a computing module is disclosed in more details in relationship with FIG. 9.

In an embodiment of the disclosure, during the training phase, using mathematical models and machine learning techniques with a trainer (ie the reference flow meter), module 3 provides learning, i.e., establishing relationships between the readings of the set of sensors 2 and the values of the flow rates of each phase and/or component obtained by means of the reference flow meter 4. Reference flow meter 4 measures the volumetric or mass flow rate per unit of time for each phase/component of a multiphase and/or multi-component flow, e.g., volumetric flow in terms of m3/day for oil, water and gas. In addition to the flow rate parameters, the reference flow meter 4 can calculate additional flow parameters, such as the density of each component, the density of fluid flows, volume and mass fraction of each of the phases and/or pressure and temperature in the flow line. It is used as a reference for training and makes it possible to establish a relationship (correlation) between sensor readings and flow rates. Conceptually, flow meter 4 plays the role of a "teacher" for the whole system and its output may be used in particular, in supervised machine learning methods. Any flow meter can be used as reference flow meter 4 (e.g., Schlumberger Vx™ meter—whose description is available at www.slb.com/reservoir-characterization/reservoir-testing/surface-testing/surface-multiphase-flowmetering/vx-spectra-surface-multiphase-flowmeter), which is capable of continuous and accurate flow measurement of multicomponent and/or multiphase fluid flows.

During the training phase, any mathematical and/or machine learning appropriate method may be used. Such method uses as an input the measurements from the set of sensors 2 and the reference flow meter 4 taken in various conditions during the training phase and provides as an output a correlation function (or relationship) that correlate the measurement of the set of sensors 2 to one or more parameters of interest (in particular flow rate of each phase and/or component) determined by the reference flow meter. Training a mathematical model using a machine learning technique may for instance include setting coefficients of the model using the data obtained from the sensor and the reference flow meter.

Figure 8:
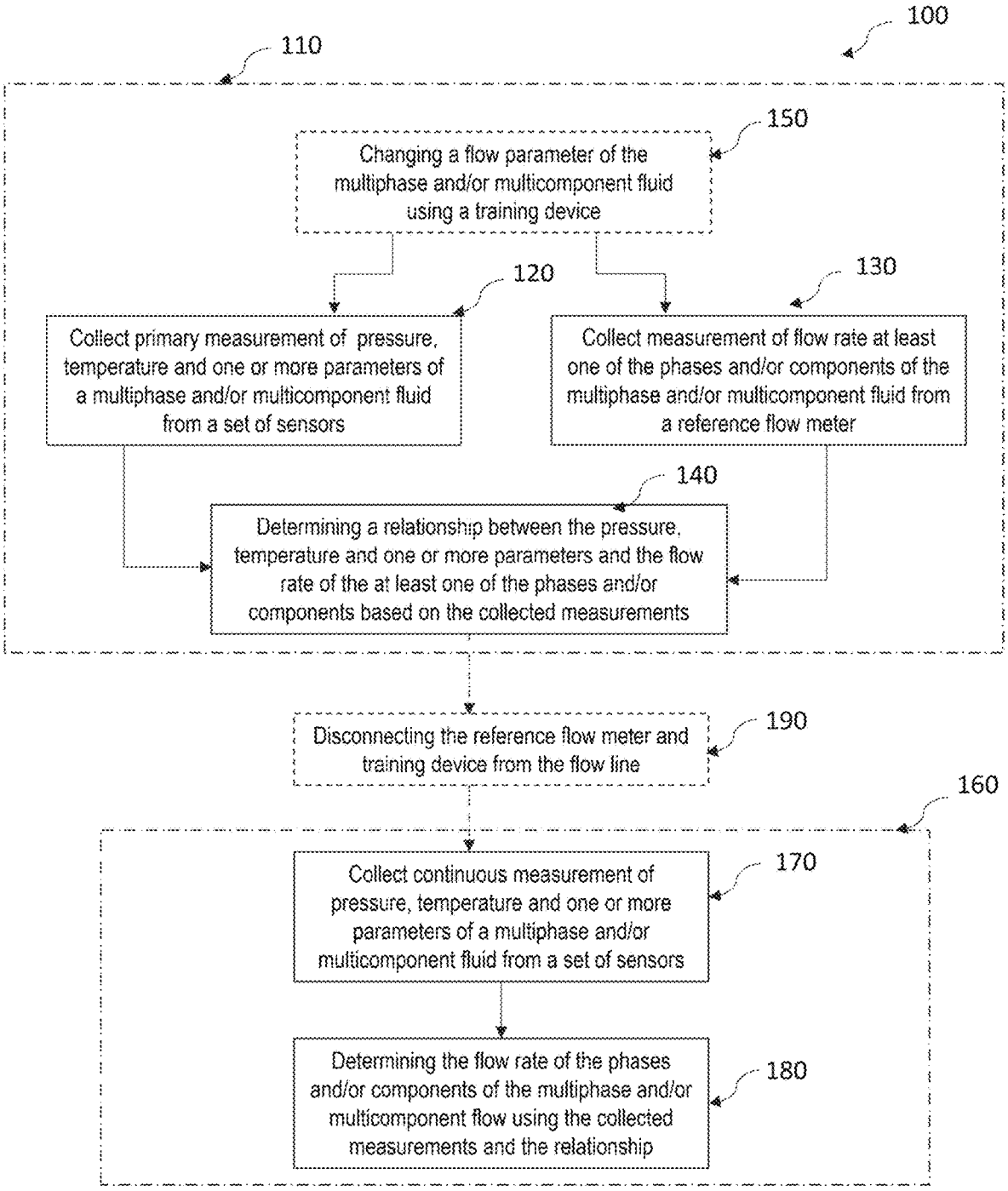
FIG. 8 is a flowchart of a method according to an embodiment of the disclosure.

A method 100 according to an embodiment of the disclosure is disclosure in relationship with FIG. 8. The method first comprises a training stage 110.

During the training stage 110, the method collects (block 120) measurements coming from the set of sensors 2 and relative to the multiphase and/or multicomponent fluid. The measurements relate to parameters comprising a pressure, a temperature and at least one additional parameter (such as the one or more additional parameters indicated above). The method also simultaneously collects (block 130) from the reference flow meter 4 a flow rate of the phases and/or components of the multiphase and/or multicomponent fluid. Both measurements collected from the set of sensors and the reference flow meter are continuous measurements. The method then includes determining a relationship (or correlation function) (block 140) between the pressure, temperature and one or more parameters coming from the set of sensors 2 and the flow rates obtained from the reference flow meter 4, based on the collected measurements. During the training phase 110, it is important to collect a sufficient amount of data in order to establish a strong relationship between the readings of the set of sensors 2 and the flow values, i.e., to train the flow measurement system.

In order to obtain a more robust training, during training stage, an additional training may be optionally performed by changing the flow parameters of the produced fluid and collecting the measurements when the flow parameters have changed. For this purpose, a training device 5 is used to change the flow parameters (water cut (WC), gas volume fraction (GVF), etc.). The training phase 110 of the method 100 may then include (block 150) changing at least one parameter of the flow of a multiphase and/or multicomponent fluid using a training device. Of course, for the sake of simplicity, on FIG. 8, block 150 is shown as occurring before blocks 120, 130 that relate to collecting measurements but, in an embodiment, initial measurements may be collected via the set of sensors and the reference flow meter, then one or more of the flow parameters may be changed (one or several times) using the training device and additional measurements as per block 120 and 130 may be collected after the changes have occurred.

The role of the training device 5 is to artificially vary the parameters of the studied flow, such as the water cut, gas factor, gas, oil and water flow rates. For example, such a device may consist of an additional set of pipes, reservoirs, pumps, separators, and flow meters, which can inject or discharge a specific volume of liquid and gas into the flow before it is measured. This procedure adds adaptability to the whole system, allows it to expand the confidence interval of flow parameters, which makes it possible to increase the accuracy and stability of measurements, when the reference flow meter is turned off after the training stage.

Generally, additional measurements with the reference flow meter 4 and the set of sensors 2 are performed until the mathematical model or machine learning model has been trained to the required level of accuracy in measuring the flow rates of components and phases, or until the training stage exceeds a specified time interval (e.g., 2 days). For example, the required level of accuracy can be specified in terms of the relative error (e.g., 5 percent) of the instantaneous or cumulative oil, liquid and gas flow rates calculated between the flow rates obtained using the reference flow meter and the set of sensors 2 for the calibration data.

The method may therefore optionally include comparing the flow rate of the at least one phase and/or component of the produced fluid measured by the reference flow meter to a predicted flow rate of the at least one phase and/or component during the training phase. The predicted flow rate is in this case determined based on the simultaneous primary measurements and the established relationship. The method may also include determining a relative error between the measured flow rate of the at least one phase and/or component of the produced fluid and the predicted flow rate of the at least phase and/or component of the produced fluid. Once the relative error has been determined, the method may include comparing the relative error to a predetermined threshold and terminating the training phase if the relative error is below the predetermined threshold (e.g., 5 percent or any other appropriate threshold determined by the one of ordinary skill). On the contrary, if the relative threshold is above the predetermined threshold, the training phase continues. The relative error may be determined based on one or more flow rates taken at a punctual time or more robustly based on measurements taken during a longer time period.

When the learning process is completed and the relationship between the sensor readings and flow rates established with the desired level of accuracy, the method includes a second phase, i.e., production phase 160. During the production phase 160, the method includes collecting (block 170) the measurements of pressure, temperature and at least one additional flow parameter obtained from set of sensors 2 and the computing module 3 independently determines (or calculates) the flow rates of the phases and components with sufficient accuracy based on the measurements of pressure, temperature and at least one additional flow parameter via sensor set 2 and the established relationship (block 180). The flow rates may be determined in real-time. Before the production phase 160 starts, the reference flow meter 4 is disconnected (block 190) from the flow line 1, as well as the training device 5 (if any).

The continuous data flow is constantly checked, and quality analysis, data processing and storage is carried out, as is quality assessment of the mathematical model or the machine learning model, which predicts flow rates, and possible detection of the need for further adjustment of this model or even calibration of the whole system.

According to one embodiment of the invention, additional and optional training (pre-training) of the system may be carried out, if necessary—not shown on FIG. 8. Post-training (ie an additional training stage 110) is recommended when the results of the primary measurements that were used for the initial training stage differ significantly from those observed during production. Indeed, it is possible that some well conditions change during production. Such change may include for instance a significant change in line pressure due to depletion of the reservoir over time. Therefore, a new training stage 110 may be initiated after the production phase 160 has started, in particular if it is witnessed that the well conditions have significantly evolved over time.

The following are examples of the implementation of the invention carried out using an experimental prototype of the system during a controlled experiment at the "Etalon" pouring stand from the company "OZNA."

Let us consider a first example of the implementation of the invention. A set of sensors and a reference multiphase flow meter (Vx-Spectra from Schlumberger) are connected to the pouring stand, which creates multiphase and multicomponent flows in the line and simulates the operation of a well. This bench consists of a set of pipes, reservoirs, pumps, flow meters, nozzles, sensors and allows pumping of multicomponent (exxsol, water, air) and multiphase (liquid, gas) flows through a working line (in this case a pipe with an internal diameter of 50 mm) with controlled flow rates for each and component or phases. As part of the monitored experiment, a set of sensors and a reference flow meter are also installed in the flow line and connected to the computing module for data acquisition and processing. The set of sensors contains a pressure sensor (P), a temperature sensor (T) and a differential pressure sensor (dP) installed on a diaphragm type restriction device.

Figure 2A:
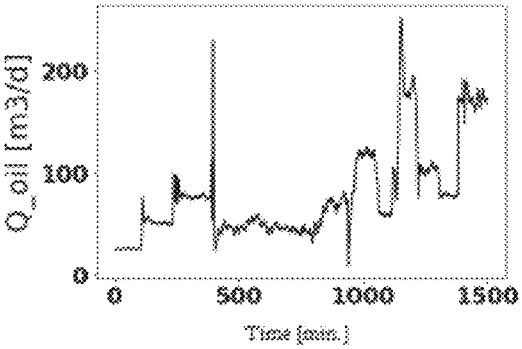
FIG. 2A is a plot showing measurement of a volumetric flow rate over time performed with the system according to a first embodiment of the disclosure at a first stage corresponding to a training of the system.
Figure 2B:
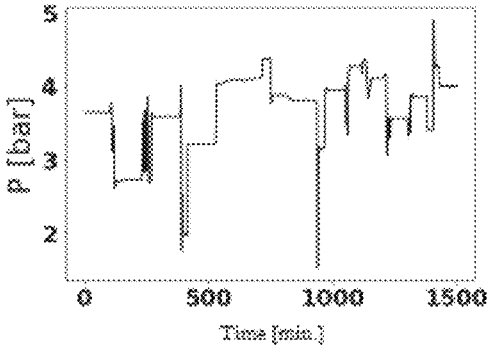
FIG. 2B is a plot showing measurement of a pressure over time performed with the system according to the first embodiment of the disclosure at the first stage.
Figure 2C:
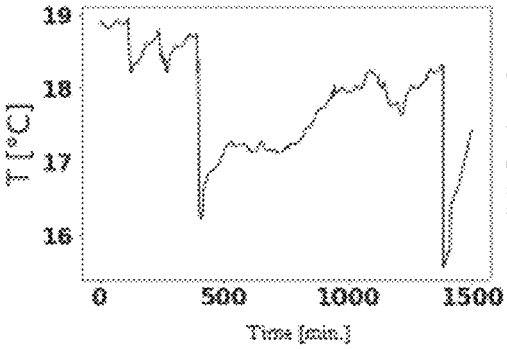
FIG. 2C is a plot showing measurement of a temperature over time performed with the system according to the first embodiment of the disclosure at the first stage.
Figure 2D:
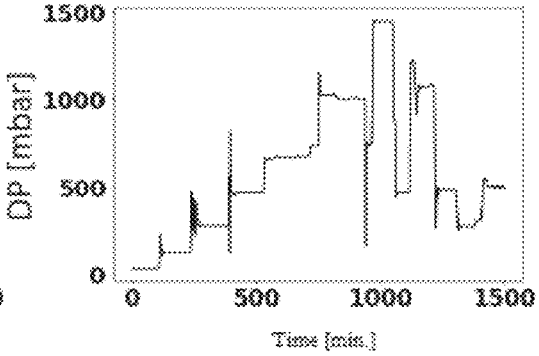
FIG. 2D is a plot showing measurement of a differential pressure over time performed with the system according to the first embodiment of the disclosure at the first stage.

During the training phase, data are collected from the sensors and flow meter, as explained above in relationship with FIG. 8. FIG. 2A shows the results of measuring the volumetric flow rate of oil with reference flow meter; FIG. 2B shows the results of measurement; FIG. 2C shows the results of temperature measurements; and FIG. 2D shows the results of measuring the differential pressure. The purpose of this training phase is to collect data and establish a relationship between flow rates and the pressure, temperature and differential pressure sensor values ($Q=f(P,T,dP)$).

Figure 3A:
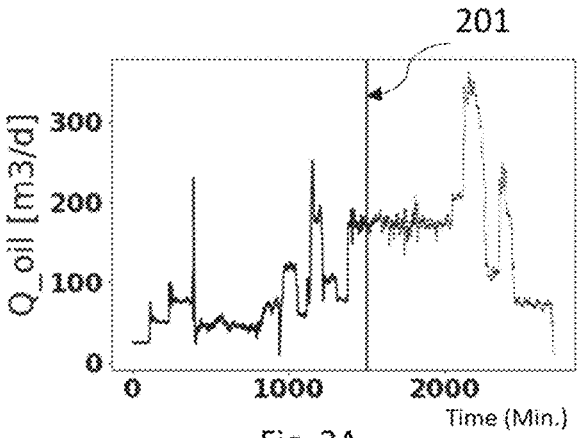
FIG. 3A is a plot showing measurement of a volumetric flow rate over time performed with the system according to the first embodiment of the disclosure at the first stage as well as at a second stage corresponding to production of the well.
Figure 3B:
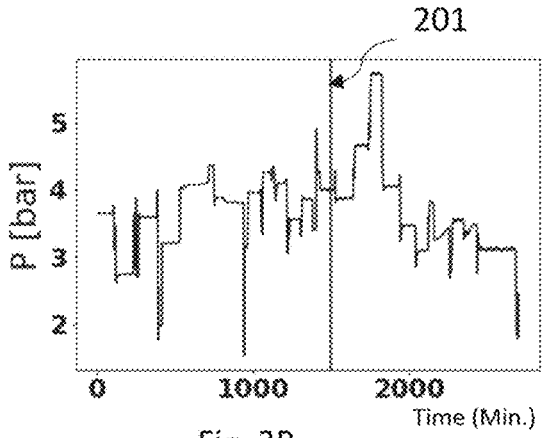
FIG. 3B is a plot showing measurement of a pressure over time performed with the system according to the first embodiment of the disclosure at the first and second stages.
Figure 3C:
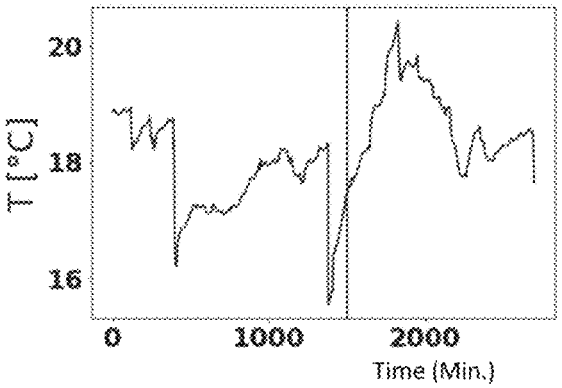
FIG. 3C is a plot showing measurement of a temperature over time performed with the system according to the first embodiment of the disclosure at the first and second stages.
Figure 3D:
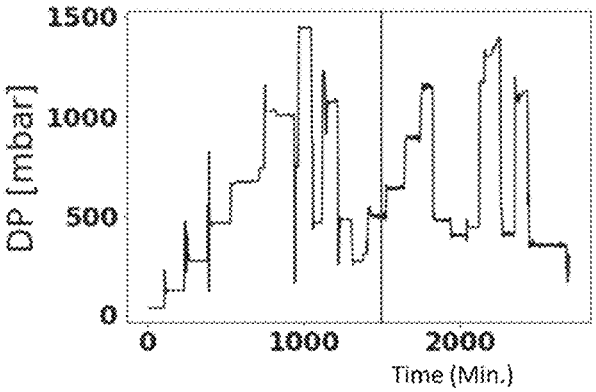
FIG. 3D is a plot showing measurement of a differential pressure over time performed with the system according to the first embodiment of the disclosure at the first and second stages.

Once the data has been acquired and the process of correlating flow rates and sensor values completed, the reference flow meter is disconnected from the system. The method then enters a phase corresponding to the production phase disclosed hereinabove in relationship with FIG. 8. All that remains is a set of sensors that continues to acquire current data from pressure, temperature, and differential pressure sensors, as well as the computational module, which includes a model (i.e., the established relationship) calibrated by way of machine learning techniques, and which calculates flows from this data. The data shown in FIGS. 3A to 3D repeat the data from FIGS. 2A to 2D up to the vertical line 201, which corresponds to the moment, when the reference is disconnected from the system. Moreover, the pressure sensors (FIG. 3B), temperature (FIG. 3C) and differential pressure (FIG. 3D) continue to read data, however, the volumetric flow rate of oil (FIG. 3A) is no longer read but is predicted by a machine learning model. In FIG. 3A, these predictions are shown by a dotted line.

Figure 4A:
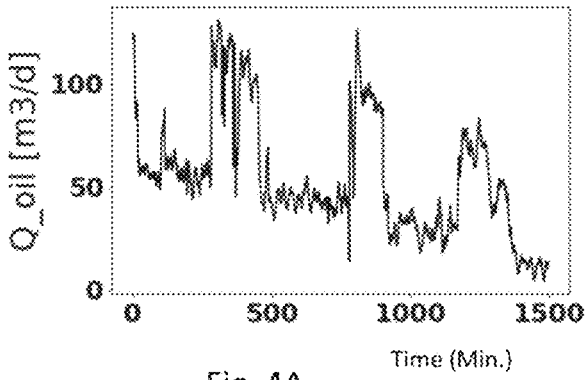
FIG. 4A is a plot showing measurement of a volumetric flow rate over time performed with a system according to a second embodiment of the disclosure at a first stage corresponding to a training of the system.
Figure 4B:
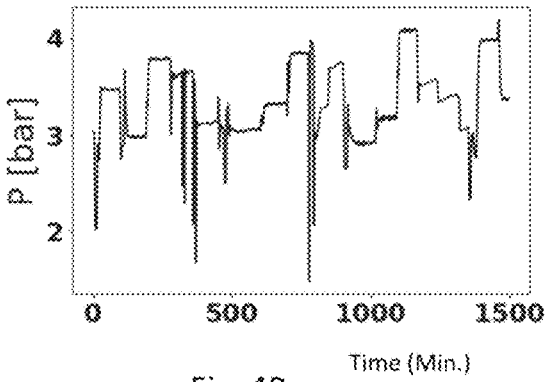
FIG. 4B is a plot showing measurement of a pressure over time performed with the system according to the second embodiment of the disclosure at the first stage.
Figure 4C:
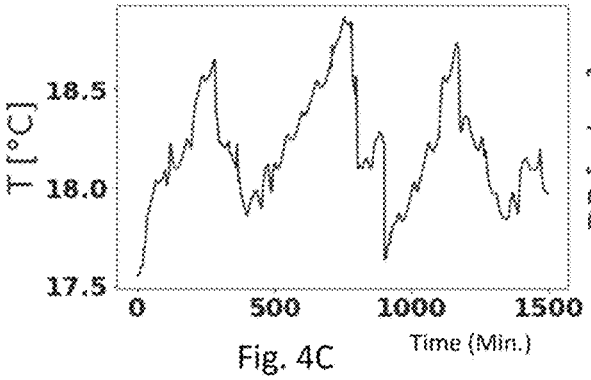
FIG. 4C is a plot showing measurement of a temperature over time performed with the system according to the second embodiment of the disclosure at the first stage.
Figure 4D:
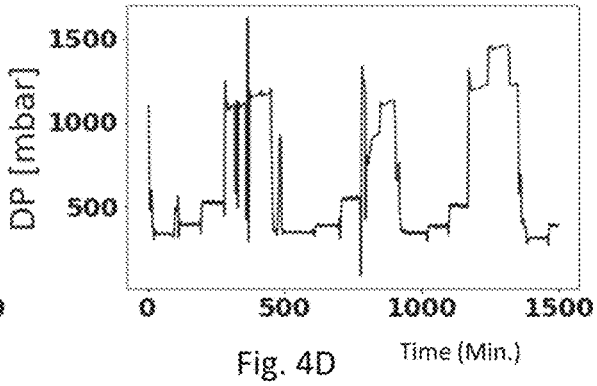
FIG. 4D is a plot showing measurement of a differential pressure over time performed with the system according to the second embodiment of the disclosure at the first stage.
Figure 4E:
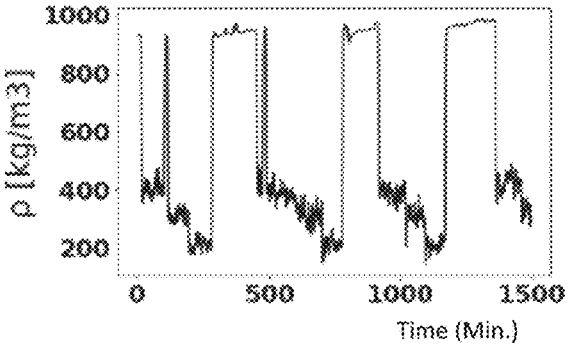
FIG. 4E is a plot showing measurement of a mixture density over time performed with the system according to the second embodiment of the disclosure at the first stage.
Figure 4F:
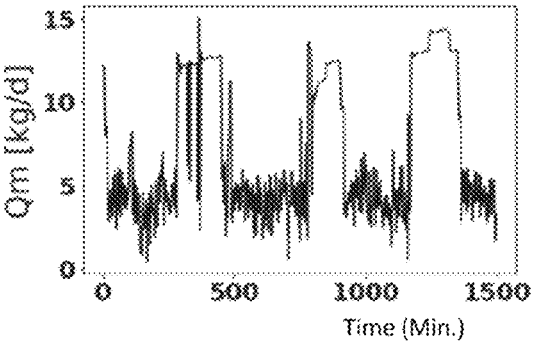
FIG. 4F is a plot showing measurement of a total mass flow rate over time performed with the system according to the second embodiment of the disclosure at the first stage.

Consider another example, where the set of sensors contains a pressure sensor, a temperature sensor, a differential pressure sensor, and a Coriolis mass flow meter, which captures the fluid flow density and total mass flow through the line. The first stage (training stage) of data acquisition includes measuring the volumetric flow rate of oil by means of a reference flow meter (FIG. 4A), measuring the pressure (FIG. 4B), the temperature (FIG. 4C), differential pressure (FIG. 4D), fluid flow density by means of a Coriolis mass flow meter (FIG. 4E), and the total mass flow using the same flow meter (FIG. 4F).

Figure 5A:
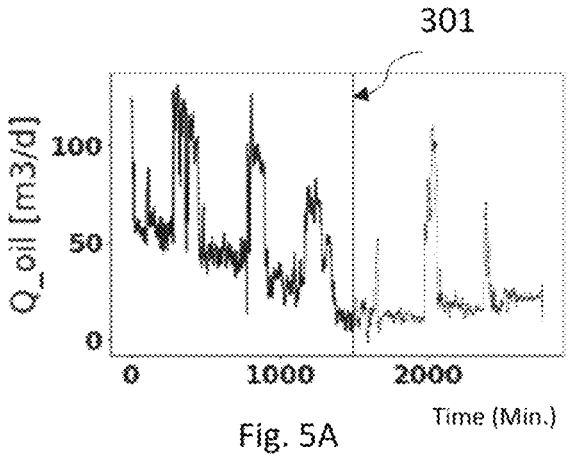
FIG. 5A is a plot showing measurement of a volumetric flow rate over time performed with the system according to the second embodiment of the disclosure at the first stage as well as at a second stage corresponding to a production of the well.
Figure 5B:
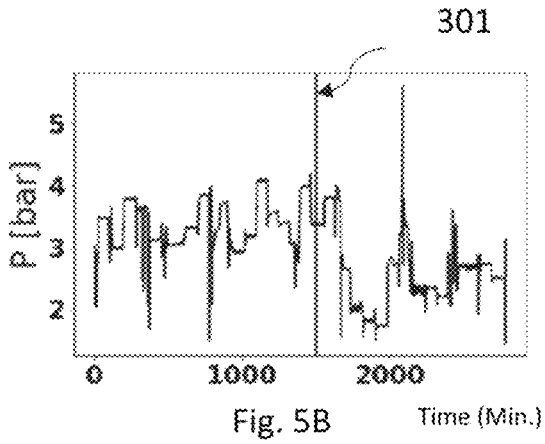
FIG. 5B is a plot showing measurement of a pressure over time performed with the system according to the second embodiment of the disclosure at the first and second stages.
Figure 5C:
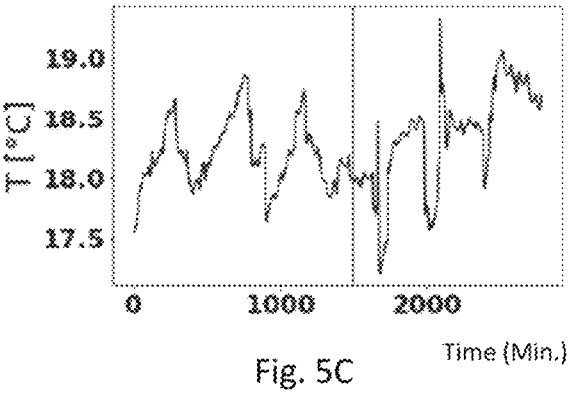
FIG. 5C is a plot showing measurement of a temperature over time performed with the system according to the second embodiment of the disclosure at the first and second stages.
Figure 5D:
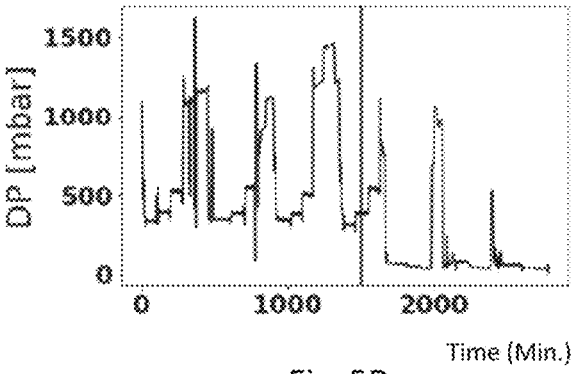
FIG. 5D is a plot showing measurement of a differential pressure over time performed with the system according to the second embodiment of the disclosure at the first and second stages.
Figure 5E:
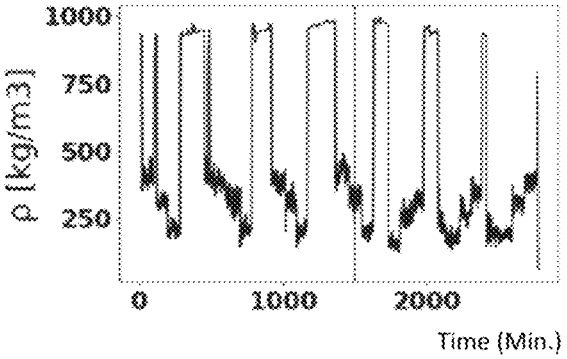
FIG. 5E is a plot showing measurement of a mixture density over time performed with the system according to the second embodiment of the disclosure at the first and second stages.
Figure 5F:
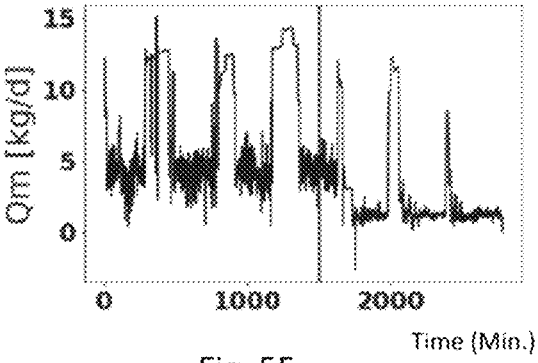
FIG. 5F is a plot showing measurement of a total mass flow rate over time performed with the system according to the second embodiment of the disclosure at the first and second stages.

In the second stage (production stage), the reference flow meter is disconnected from the system. This leaves only a set of sensors that continue to read data from the pressure sensor (FIG. 5B), the temperature sensor (FIG. 5C), the differential pressure sensor (FIG. 5D) and the Coriolis sensor (FIG. 5E, and FIG. 5F). From this data, the machine learning model predicts the volumetric flow rate of oil (FIG. 5A). FIGS. 5A to 5F show the data from the first and second stages, which are separated by a vertical line 301, and the predicted volumetric flow rates of oil are shown by a dotted line.

Consider the example of multicomponent flow, where both gas and liquid are present in the well. We will also demonstrate the operation of a training device that provides a change in flow parameters in order to expand the range of observed values. As a training device, we will consider a set of pipes, pumps, tanks, sensors, which allow for controlling the per-component flow rate in the line, and being part of the pouring stand in the experiment being conducted.

Figure 6A:
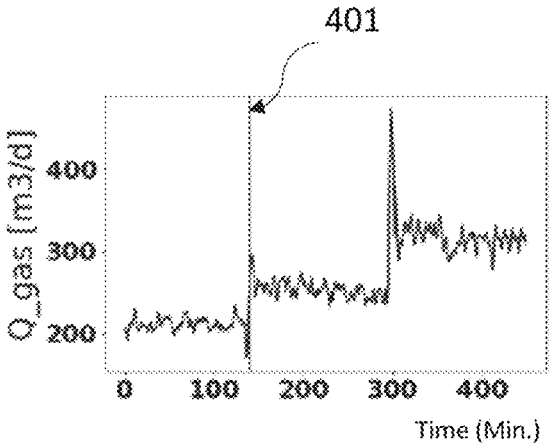
FIG. 6A is a plot showing measurement of a gas flow rate over time performed with a system according to a third embodiment of the disclosure at a first stage corresponding to a training of the system.
Figure 6B:
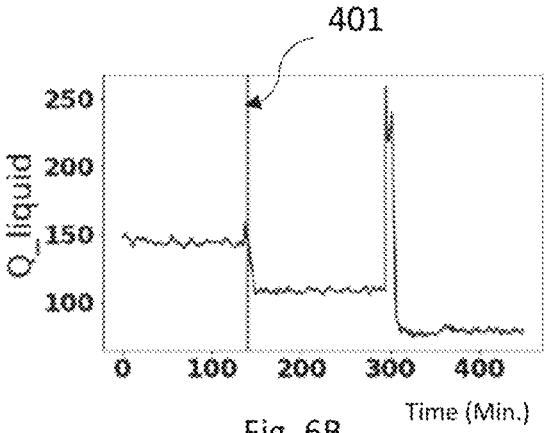
FIG. 6B is a plot showing measurement of a liquid flow rate over time performed with the system according to the third embodiment of the disclosure at the first stage.
Figure 6C:
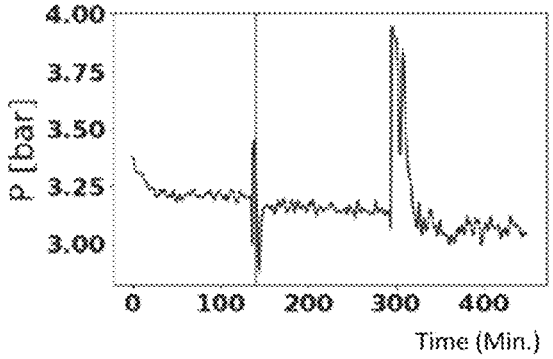
FIG. 6C is a plot showing measurement of a pressure over time performed with the system according to the third embodiment of the disclosure at the first stage.
Figure 6D:
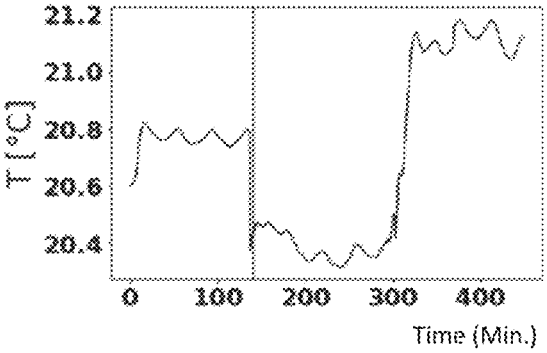
FIG. 6D is a plot showing measurement of a temperature over time performed with the system according to the third embodiment of the disclosure at the first stage.
Figure 6E:
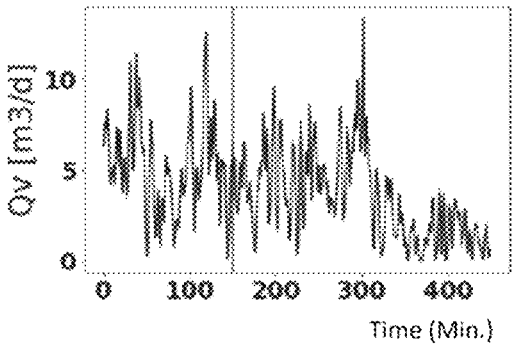
FIG. 6E is a plot showing measurement of a volumetric flow rate over time performed with the system according to the third embodiment of the disclosure at the first stage.
Figure 6F:
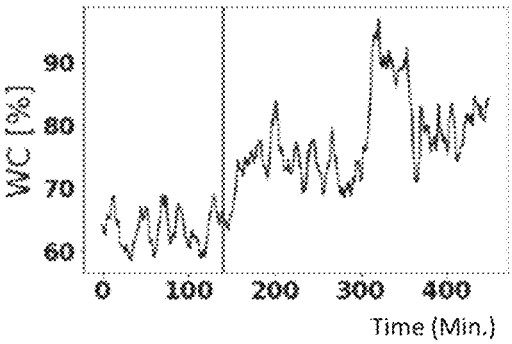
FIG. 6F is a plot showing measurement of a water cut over time performed with the system according to the third embodiment of the disclosure at the first stage.
Figure 7A:
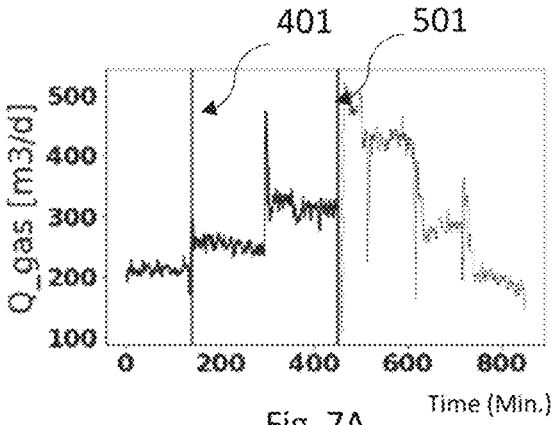
FIG. 7A is a plot showing measurement of a gas flow rate over time performed with a system according to a third embodiment of the disclosure at the first stage as well as at a second stage corresponding to production of the well.
Figure 7B:
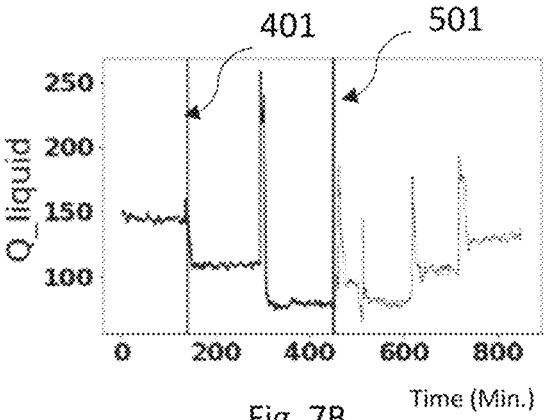
FIG. 7B is a plot showing measurement of a liquid flow rate over time performed with the system according to the third embodiment of the disclosure at the first and second stages.
Figure 7C:
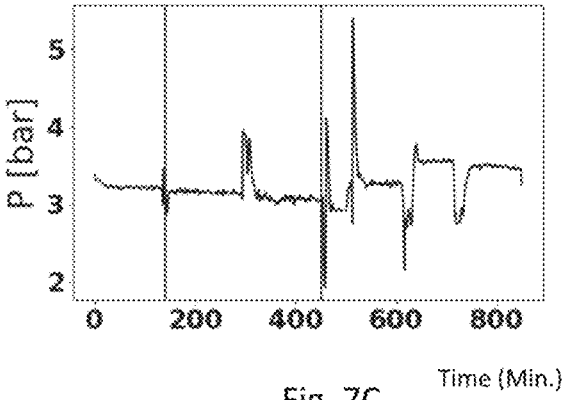
FIG. 7C is a plot showing measurement of a pressure over time performed with the system according to the third embodiment of the disclosure at the first and second stages.
Figure 7D:
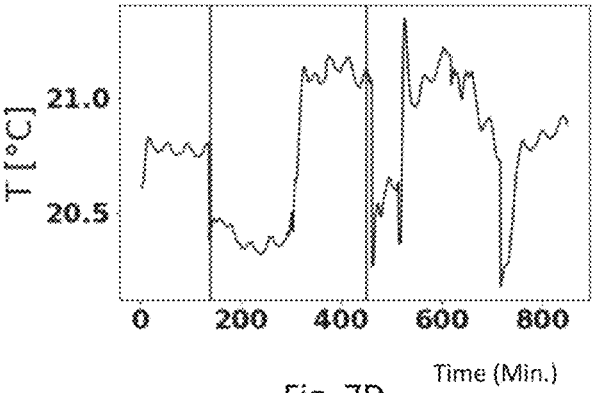
FIG. 7D is a plot showing measurement of a temperature over time performed with the system according to the third embodiment of the disclosure at the first and second stages.
Figure 7E:
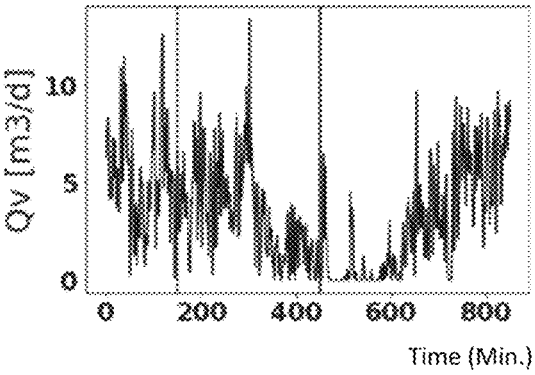
FIG. 7E is a plot showing measurement of a volumetric flow rate over time performed with the system according to the third embodiment of the disclosure at the first and second stages.
Figure 7F:
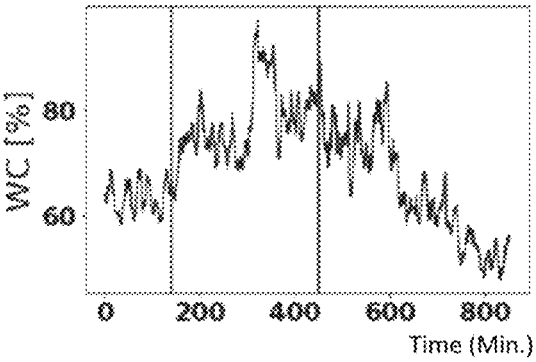
FIG. 7F is a plot showing measurement of a water cut over time performed with the system according to the third embodiment of the disclosure at the first and second stages.

In this case, the set of sensors contains a pressure sensor, a temperature sensor, a turbine flowmeter, which measures volumetric flow rate (Qv), and a watercut sensor, which measures the fraction of water in the liquid phase (WC). The data recorded by the sensors is shown on the Figures: data recorded by the pressure sensor is shown on FIG. 6C, data recorded by the temperature sensor is shown on FIG. 6D, data recorded by the turbine flowmeter is shown on FIG. 6E and data recorded by the watercut sensor is shown on FIG. 6F. In this example, the reference flowmeter captures the gas and liquid flow rates, which will be predicted when the reference flowmeter is disconnected from the system. The gas and liquid flow rates are shown on FIGS. 6A and 6B.

This example uses a training device, which changes the flow parameters in the following way: it adds gas to the system and removes liquid from the system, causing the system to change both pressure, temperature, water cut and total volumetric flow. This approach of varying the parameters is consistent with a possible well-development variant: when, due to a decrease in bottomhole pressure, line pressure also decreases over time resulting in an increase in the gas volume fraction and a decrease in the oil fraction. When using a training device, the learning process of a mathematical model or machine-learning model may be divided into two parts: learning without the use of a training device and learning using a training device.

In FIGS. 6A-6F, these steps are separated by a vertical line 401. From the temperature-sensor T (° C.) data on FIG. 6D and watercut WC (%) data on FIG. 6F, it can be seen that the training device greatly changes the range of observed values. For the watercut sensor, for example, the values range from 60% to 70%, however, a training device can provide values up to 95%. Thus, the data is enriched in order to properly build a machine learning model that can predict the flow rates more accurately and over a longer period of time. The prediction stage remains unchanged, i.e., the training device and the reference flowmeter are disconnected from the system and continue to read the data from the pressure, temperature, turbine flowmeter and watercut sensors. From this data, the already trained machine-learning (or mathematical) model is able to calculate both gas and liquid flow rates. In FIGS. 7A-7F, the first two stages separated by the vertical line 401 repeat the learning process shown in FIGS. 6A-6F, and the third stage separated from the second stage by the vertical line 501 is the prediction stage, in which the gas and oil flow rates are indicated by a dotted line.

Figure 9:
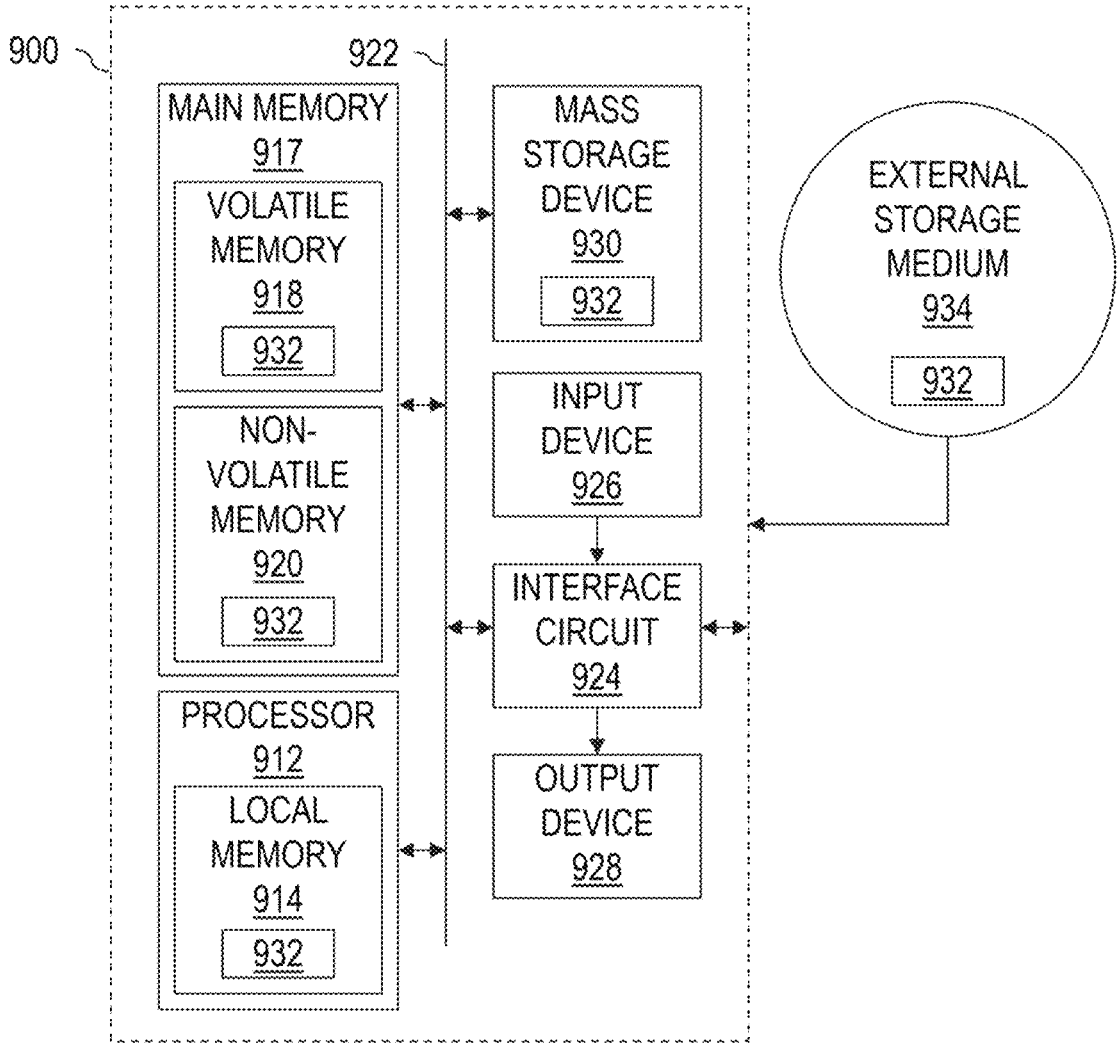
FIG. 9 is a diagram of a computing module according to an embodiment of the disclosure.

A detailed example of a computing module is provided in relationship to FIG. 9.

The computing module 900 may comprise a processor 912, such as a general-purpose programmable processor, for example. The processor 912 may comprise a local memory 914 and may execute program code instructions 932 present in the local memory 914 and/or another memory device. The processor 912 may execute, among other things, machine-readable instructions or programs to implement the methods and/or processes described herein. The programs stored in the local memory 914 may include program instructions or computer program code that, when executed by an associated processor, cause a controller and/or control system implemented in surface equipment to perform tasks as described herein. The processor 912 may be, comprise, or be implemented by one or more processors of various types operable in the local application environment, and may include one or more general-purpose processors, special-purpose processors, microprocessors, digital signal processors (DSPs), field-programmable gate arrays (FPGAs), application-specific integrated circuits (ASICs), processors based on a multi-core processor architecture, and/or other processors.

The processor 912 may be in communication with a main memory 917, such as via a bus 922 and/or other communication means. The main memory 917 may comprise a volatile memory 918 and a non-volatile memory 920. The volatile memory 918 may be, comprise, or be implemented by random access memory (RAM), static RAM (SRAM), dynamic RAM (DRAM), synchronous DRAM memory (SDRAM), RAMBUS DRAM (RDRAM), and/or other types of RAM devices. The non-volatile memory 920 may be, comprise, or be implemented by read-only memory, flash memory, and/or other types of memory devices. One or more memory controllers (not shown) may control access to the volatile memory 918 and/or the non-volatile memory 920.

The computing module 900 may also comprise an interface circuit 924. The interface circuit 924 may be, comprise, or be implemented by various types of standard interfaces, such as an Ethernet interface, a universal serial bus (USB), a third-generation input/output (3GIO) interface, a wireless interface, and/or a cellular interface, among other examples. The interface circuit 924 may also comprise a graphics driver card. The interface circuit 924 may also comprise a communication device, such as a modem or network interface card, to facilitate exchange of data with external computing devices via a network, such as via Ethernet connection, digital subscriber line (DSL), telephone line, coaxial cable, cellular telephone system, and/or satellite, among other examples.

One or more input devices 926 may be connected to the interface circuit 924. One or more of the input devices 926 may permit a user to enter data and/or commands for utilization by the processor 912. Each input device 926 may be, comprise, or be implemented by a keyboard, a mouse, a touchscreen, a trackpad, a trackball, an image/code scanner, and/or a voice recognition system, among other examples.

One or more output devices 928 may also be connected to the interface circuit 924. One or more of the output devices 928 may be, comprise, or be implemented by a display device, such as a liquid crystal display (LCD), a light-emitting diode (LED) display, and/or a cathode ray tube (CRT) display, among other examples. One or more of the output devices 928 may also or instead be, comprise, or be implemented by a printer, speaker, and/or other examples.

The computing module 900 may also comprise a mass storage device 930 for storing machine-readable instructions and data. The mass storage device 930 may be connected to the interface circuit 924, such as via the bus 922. The mass storage device 930 may be or comprise a floppy disk drive, a hard disk drive, a compact disk (CD) drive, and/or digital versatile disk (DVD) drive, among other examples. The program code instructions 932 may be stored in the mass storage device 930, the volatile memory 918, the non-volatile memory 920, the local memory 914, and/or on a removable storage medium 934, such as a CD or DVD.

The mass storage device 930, the volatile memory 918, the non-volatile memory 920, the local memory 914, and/or the removable storage medium 934 may each be a tangible, non-transitory storage medium. The modules and/or other components of the computing module 900 may be implemented in accordance with hardware (such as in one or more integrated circuit chips, such as an ASIC), or may be implemented as software or firmware for execution by a processor. In the case of firmware or software, the implementation can be provided as a computer program product including a computer readable medium or storage structure containing computer program code (i.e., software or firmware) for execution by the processor.

The method and system according to the disclosure provides an accurate flow rate of each component and/or phase of a multiphase fluid at a reasonable cost.

In view of the entirety of the present disclosure, including the figures and the claims, a person having ordinary skill in the art will readily recognize that the present disclosure introduces a method for determining a flow rate of at least a phase or a component of a fluid produced from an oil and gas well. The fluid is one of a multiphase and of a multi-component fluid. The method comprises, in a training phase, collecting primary measurements of pressure, temperature, and at least one additional parameter of the flow of the produced fluid. The primary measurements are carried out at the wellhead by a set of sensors installed in a flow line for the produced fluid. In the training phase, the method also comprises collecting a flow rate of at least one of the phases or components of the produced fluid simultaneously measured by a reference multiphase flow meter installed in the flow line, and establishing a relationship between the pressure, temperature, and the additional at least one additional flow parameter and the flow rate of the at least one of the phases or components of the produced fluid. The method also comprises, in a subsequent production phase, determining the flow rate of the at least one of the phases or components of the produced fluid based on the primary measurements of the pressure, temperature, and the at least one additional flow parameter and on the established relationship.

In an embodiment, the method may include changing at least one flow parameter of the produced fluid in the flow line using a training device. The at least one flow parameter may include at least one of the following: a water cut (WC), a gas factor (GVF), a gas flow rate, an oil flow rate and a water flow rate.

In such embodiment, the method may include, in the training phase, collecting initial primary measurements and an initial flow rate of the at least one of the phases or components of the produced fluid, wherein the initial primary measurements and flow rates are simultaneously measured. The method then includes changing the at least one flow parameter of the produced fluid in the flow line using the training device, and collecting additional primary measurements and an additional flow rate of the at least one of the phases or components of the produced fluid after the flow parameters change, wherein the additional primary measurements and flow rates are simultaneously measured. The method includes establishing the relationship based on the initial and additional primary measurements and initial and additional flow rates of the at least one of the phases or components of the produced fluid.

The method may comprise disconnecting the reference flow meter from the flow line after the end of the training phase. When a training device has been used, the method may also include disconnecting the training device after the end of the training phase.

In an embodiment, the method may include measuring continuously the pressure, temperature, and the at least one additional parameter of the flow of the produced fluid using the set of sensors during the training and the production phase.

The method may also include measuring continuously the flow rate of the at least one of the phases or components of the produced fluid, during the training phase.

The method may also include, during the training phase, comparing the flow rate of the at least one phase or component of the produced fluid measured by the reference flow meter to a predicted flow rate of the at least one phase or component, wherein the predicted flow rate is determined based on the simultaneous primary measurements and the established relationship. In an embodiment, the method also includes determining a relative error between the measured flow rate and the predicted flow rate, comparing the relative error to a predetermined threshold, and terminating the training phase when the relative error is below the predetermined threshold.

In another embodiment, the method may include terminating the training phase when it exceeds a predetermined duration.

Establishing the relationship may include training a machine learning model. In particular, the machine learning model may be a supervised machine learning model. Training the machine learning model may include determine one or more coefficients of the model.

The at least one additional parameter of the flow of the produced fluid collected as part of the primary measurements may include at least one of the following: effective fluid flow rate, velocity of at least one of the phases or components of the produced fluid, sound speed in the flow medium, effective density of a mixture of components or one or more phases, volume fraction of one or more components or phases, component viscosities, effective viscosity, dielectric permittivity, or conductivity.

The method may include selecting the at least one additional parameter based on previous downhole or surface measurements.

The method may also include obtaining at least one additional reference parameter using the reference flow meter during the training phase, and using the one or more additional reference parameter to establish the relationship. The at least one additional reference parameter may include at least one of: a density of each component of the produced fluid, volume and mass fraction of each of the phases, pressure and temperature in the flow line.

The phases or components of the produced fluid include at least one of: liquid, gas, oil and water.

The disclosure also introduces a system for determining a flow rate of at least a phase or component of a fluid produced from an oil and gas well. The fluid is one of a multiphase and of a multicomponent fluid. The system comprises a set of sensors configured to carry out primary measurements including a measurement of pressure, temperature, and at least one additional flow parameter of the produced fluid, and installed in the produced fluid flow line at the wellhead. It also comprises a reference multiphase flow meter configured to measure the flow rate of the at least one of the phases or components of the produced fluid and installed in the flow line of the produced fluid at the wellhead. The system also includes a computing module configured to collect the primary measurements from the set of sensors and the flow rate of the at least one of the phases or components from the reference multiphase flowmeter and establish a relationship between the measured pressure, temperature, and additional flow parameter of the produced fluid and the flow rate of the at least one of the phases and/or components of the produced fluid. The computing module is also configured to determine the flow rate of the at least one of the phases or components of the produced fluid based on the primary measurements and the established relationship.

The system may additionally comprise a training device designed to change at least one parameter of the flow of the produced fluid. For example, such a device may consist of an additional set of pipes, reservoirs, pumps, separators, and flow meters, which can inject or discharge a specific volume of liquid and gas into the flow before it is measured.

The set of sensors may comprise one or more of the following sensors: a Coriolis flow meter, an electromagnetic flow meter, an ultrasonic flow meter, a turbine flow meter, a vortex flow meter, a restriction device, an ultrasonic sensor for measuring one or more of transit time, speed of sound, or Doppler shift, an optical sensor, an infrared sensor, an X-ray sensor, a watercut sensor, an inductance sensor, a conductivity sensor, a resistance sensor, a microwave sensor, a capacitance sensor, a pressure sensor, a differential pressure sensor, a temperature sensor.

The computing module may be configured to perform one or more actions disclosed hereinabove in relationship with the method according to the disclosure.

The disclosure also relates to method for determining a flow rate of at least a phase or a component of a fluid produced from an oil and gas well. The fluid is one of a multiphase and of a multicomponent fluid. The method comprises determining a flow rate of at least one of the phases or components of the produced fluid based on primary measurements of pressure, temperature, and at least one additional flow parameter and on an established relationship. The primary measurements are carried out at the wellhead by a set of sensors installed in a flow line for the produced fluid. The relationship has been established based on the primary measurements of pressure, temperature, and at least one additional flow parameter and on a flow rate of at least one of the phases or components of the produced fluid simultaneously measured by a reference multiphase flow meter installed in the flow line.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the implementations introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

The invention claimed is:

1. A method for determining a flow rate of at least a phase or a component of a fluid produced from a well containing at least one of oil or gas, the fluid being at least one of a multiphase fluid or a multicomponent fluid, the method comprising:

during a training phase:

collecting initial primary measurements of pressure, temperature, and at least one additional parameter of the fluid, the collecting being carried out at a wellhead of the well by a set of sensors installed in a flow line for the fluid;

collecting an initial flow rate measurement of the at least the phase or the component of the fluid by a reference multiphase flow meter installed in the flow line, the initial primary measurements and the initial flow rate measurement being collected simultaneously; and establishing a relationship between:

the initial primary measurements of the pressure, the temperature, and the at least one additional parameter; and the initial flow rate measurement of the at least the phase or the component of the fluid;

during a production phase, subsequent to the training phase:

determining the flow rate of the at least the phase or the component of the fluid based on:

collecting subsequent primary measurements of the pressure, the temperature, and the at least one additional parameter of the fluid; and the established relationship; and controlling the well based on the determined flow rate of the at least the phase or the component of the fluid.

2. The method according to claim 1, further comprising changing at least one flow parameter of the fluid in the flow line using a training device.

3. The method according to claim 2, further comprising, during the training phase:

changing the at least one flow parameter of the fluid in the flow line using the training device; and collecting additional primary measurements of the pressure, the temperature, and the at least one additional parameter of the fluid and an additional flow rate measurement of the at least the phase or the component of the fluid after the flow parameters change, the additional primary measurements and the additional flow rate measurement being collected simultaneously, wherein the establishing the relationship is further based on the initial and the additional primary measurements and the initial and the additional flow rate measurements of the at least the phase or the component of the fluid.

4. The method according to claim 2, wherein the changing the at least one flow parameter includes changing at least one of: a water cut (WC), a gas factor (GVF), a gas flow rate, an oil flow rate, or a water flow rate.

5. The method according to claim 1, further comprising disconnecting the reference multiphase flow meter from the flow line after completion of the training phase and before completion of the production phase.

6. The method according to claim 2, further comprising disconnecting the training device after completion of the training phase and before starting the production phase.

7. The method according to claim 1, wherein:

the collecting the initial primary measurements during the training phase comprises continuously measuring the pressure, the temperature, and the at least one additional parameter of the fluid using the set of sensors; and the collecting the subsequent primary measurements during the production phase comprises continuously measuring the pressure, the temperature, and the at least one additional parameter of the fluid using the set of sensors.

8. The method according to claim 1, wherein the collecting the initial flow rate measurement during the training phase comprises continuously measuring the flow rate of the at least the phase or the component of the fluid.

9. The method according to claim 1, further comprising, during the training phase:

comparing the flow rate of the at least the phase or the component of the fluid measured by the reference multiphase flow meter to one or more predicted flow rates of the at least the phase or the component, the one or more predicted flow rates being determined based on the established relationship;

determining a relative error between the initial flow rate measurement and the one or more predicted flow rates based on the comparing;

comparing the relative error to a predetermined threshold;

adjusting the relationship between the initial primary measurements of the temperature, the pressure, and the at least one additional parameter of the fluid and the initial flow rate measurement of the at least the phase or the component of the fluid when the relative error is equal to above the predetermined threshold; and terminating the training phase when the relative error is below the predetermined threshold.

10. The method according to claim 1, wherein:

the establishing the relationship includes training a machine learning model to predict a subsequent flow rate of the at least the phase or the component of the fluid based on the subsequent primary measurements of the pressure, the temperature, and the at least one additional parameter of the fluid; and the determining the flow rate of the at least the phase or the component of the fluid comprises predicting the subsequent flow rate of the at least the phase or the component of the fluid by inputting the subsequent primary measurements of the pressure, the temperature, and the at least one additional parameter of the fluid to the machine learning model to obtain the predicted subsequent flow rate of the at least the phase or the component of the fluid.

11. The method according to claim 10, wherein the machine learning model is a supervised machine learning model.

12. The method according to claim 1, wherein the at least one additional parameter of the fluid collected as part of the primary measurements includes at least one of: effective fluid flow rate, velocity of at least one of the phases or components of the fluid, sound speed in the flow medium, effective density of a mixture of components or one or more phases, volume fraction of one or more components or phases, component viscosities, effective viscosity, dielectric permittivity, or conductivity.

13. The method according to claim 1, further comprising selecting the at least one additional parameter based on previous downhole or surface measurements.

14. The method according to claim 1, further comprising:

obtaining at least one additional reference parameter using the reference multiphase flow meter during the training phase; and using the at least one additional reference parameter to establish the relationship.

15. The method according to claim 14, wherein the at least one additional reference parameter includes at least one of: density of each component of the fluid, volume and mass fraction of each phase of the fluid, pressure in the flow line, or temperature in the flow line.

16. The method according to claim 1, wherein the at least the phase or the component of the fluid includes at least one of: liquid, gas, oil, or water.

17. A system for determining a flow rate of at least a phase or component of a fluid produced from a well containing at least one of oil or gas, the fluid being at least one of a multiphase fluid or multicomponent fluid, the system comprising:

a set of sensors configured to carry out measurements of pressure, temperature, and at least one additional parameter of the fluid, the sensors being installed in a flow line of the fluid at a wellhead of the well;

a reference multiphase flow meter configured to carry out measurement of the flow rate of the at least the phase or the component of the fluid, the reference multiphase flow meter being installed in the flow line of the fluid at the wellhead, the measurements of the pressure, the temperature, and the at least one additional parameter of the fluid being carried out simultaneously with the flow rate measurement; and a computing module configured to:

during a training phase:

collect:

initial primary measurements of the pressure, the temperature, and the at least one additional parameter of the fluid from the set of sensors; and an initial flow rate measurement of the at least the phase or the component of the fluid from the reference multiphase flow meter, the initial primary measurements and the initial flow rate measurement being collected simultaneously; and establish a relationship between:

the initial primary measurements of the pressure, the temperature, and the at least one additional parameter of the fluid; and the initial flow rate measurement of the at least the phase or the component of the fluid; and during a production phase, subsequent to the training phase, collect subsequent primary measurements of the pressure, the temperature, and the at least one additional parameter of the fluid from the set of sensors; and determine the flow rate of the at least the phase or the component of the fluid based on the collected subsequent primary measurements and the established relationship; and control the well based on the determined flow rate of the at least the phase or the component of the fluid.

18. The system according to claim 17, further comprising a training device designed to change at least one parameter of the fluid.

19. The system according to claim 17, wherein the set of sensors comprises one or more of: a Coriolis flow meter, an electromagnetic flow meter, an ultrasonic flow meter, a turbine flow meter, a vortex flow meter, a restriction device, an ultrasonic sensor for measuring one or more of transit time, speed of sound, or Doppler shift, an optical sensor, an infrared sensor, an X-ray sensor, a watercut sensor, an inductance sensor, a conductivity sensor, a resistance sensor, a microwave sensor, a capacitance sensor, a pressure sensor, a differential pressure sensor, or a temperature sensor.

20. A method for determining a flow rate of at least a phase or a component of a fluid produced from a well containing at least one of oil or gas, the fluid being at least one of a multiphase fluid or a multicomponent fluid, the method comprising determining a flow rate of the at least the phase or the component of the fluid based on primary measurements of pressure, temperature, and at least one additional parameter and on an established relationship; and controlling the well based on the determined flow rate of the at least the phase or the component of the fluid, wherein the primary measurements are carried out at a wellhead of the well by a set of sensors installed in a flow line for the fluid, and wherein the established relationship is a relationship between measurements of the pressure, the temperature, and the at least one additional parameter and a flow rate measurement of the at least the phase or the component of the fluid measured by a reference multiphase flow meter installed in the flow line, wherein the measurements of the pressure, the temperature, and the at least one additional parameter and the flow rate measurement are collected simultaneously.

* * * * *